US008640638B2

(12) United States Patent
Lee

(10) Patent No.: US 8,640,638 B2
(45) Date of Patent: Feb. 4, 2014

(54) SEWING MACHINE AND CONTROL METHOD FOR DRIVING THE SAME

(75) Inventor: Dong Gyu Lee, Incheon (KR)

(73) Assignee: Sunstar Co., Ltd., Incheon (KR)

( * ) Notice: Subject to any disclaimer, the term of this patent is extended or adjusted under 35 U.S.C. 154(b) by 0 days.

(21) Appl. No.: 13/474,767

(22) Filed: May 18, 2012

(65) Prior Publication Data

US 2012/0291683 A1 Nov. 22, 2012

(30) Foreign Application Priority Data

May 20, 2011 (KR) ..... 10-2011-0048014

(51) Int. Cl.
*D05B 19/00* (2006.01)

(52) U.S. Cl.
USPC ..... 112/470.05

(58) Field of Classification Search
USPC ..... 112/470.05, 470.13, 470.17, 98, 220, 112/258, 259
See application file for complete search history.

(56) References Cited

U.S. PATENT DOCUMENTS

| | | | | | |
|---|---|---|---|---|---|
| 3,589,320 | A | * | 6/1971 | Beazley | 112/470.05 |
| 3,994,246 | A | * | 11/1976 | Boser | 112/470.04 |
| 4,116,147 | A | * | 9/1978 | Matthews | 112/217.1 |
| 4,373,458 | A | * | 2/1983 | Dorosz et al. | 112/470.06 |
| 5,540,165 | A | * | 7/1996 | Katou et al. | 112/470.13 |
| 5,553,564 | A | * | 9/1996 | Putney | 112/470.13 |
| 5,743,200 | A | * | 4/1998 | Miller et al. | 112/80.01 |

* cited by examiner

*Primary Examiner* — Tejash Patel
(74) *Attorney, Agent, or Firm* — LRK Patent Law Firm

(57) ABSTRACT

A sewing machine having a rotatable head portion includes a sewing machine frame shaped in a box using supporting posts and supporting bars to hold the sewing machine; a sewing machine main body mounted on the sewing machine frame; a head portion disposed at the front end of the sewing machine main body and rotatably installed through head portion rotating means; a bed portion rotatably installed under the head portion through bed portion rotating means; X-axis transporting means moving the sewing machine main body mounted on the sewing machine frame in X direction; Y-axis transporting means moving the sewing machine main body mounted on the sewing machine frame in Y direction; and a sewing object fixing frame provided at the front part of the sewing machine frame where the sewing object is held. The head portion and the bed portion are rotated to sew the sewing object.

18 Claims, 17 Drawing Sheets

SEWING MACHINE AND CONTROL METHOD FOR DRIVING THE SAME

BACKGROUND OF THE INVENTION

1. Field of the Invention

The present invention relates to a sewing machine and a control method for driving the sewing machine, and more particularly to a sewing machine and a control method for driving the sewing machine having a rotatable head portion in order to implement a perfect sewing operation without a hitch stitch when sewing an airbag, a bag, shoes or the like.

2. Description of the Prior Art

As generally known in the art, a workpiece or object to be sewn (referred to as a "sewing object" hereinafter) such as an airbag, a bag, shoes or the like is thick as well as has a number of sewing lines with delicate patterns to be sewn like a circular, curved or inclined line, etc. The conventional sewing machine has left a hitch stitch due to a sewing direction, which leads to drawbacks in that the stitch pattern becomes irregular to lower the quality of the sewing object.

FIG. 1 shows one example of the conventional sewing machine in which an arm portion 40 including a head portion is positioned above a table 10, and a bed portion (not shown) including a hook is disposed under the table 10. A coupling portion 60 is configured to connect the arm portion 40 with the bed portion. Hence, the head portion and the hook of the bed portion are adapted to cooperate to sew the sewing object which is fixedly held at a sewing object fixing member 50.

The sewing machine constructed above is capable of processing the sewing object in a restricted region in which the sewing object fixing member 50 is allowed to move in an X-axis or Y-axis direction with the structure of the arm-bed portions.

However, this conventional sewing machine has drawbacks in that a hitch stitch occurs between the respective stitches when performing a circular, curved or inclined stitch since the sewing object fixing member 50 linearly moves in the X-axis or Y-axis direction.

FIGS. 2A and 2B show examples where a hitch stitch occurs in the conventional sewing machine. In the case of a rhombic or rectangular pattern, it will be noted that two sides out of four sides refer to a P stitch of a perfect stitch, one side refers to an H/P stitch mixed with normal and abnormal stitches, and one side refers to an H stitch of a hitch stitch.

FIG. 2C illustrates an H-P stitch distribution between the respective stitches after a sewing operation. It will be appreciated that the P stitch (a perfect stitch) and an H stitch (a hitch stitch) occur approximately at a 1:1 ratio for a circular stitch.

Hence, there has been a need to provide a sewing machine which may implement a perfect stitch with respect to the entire stitches for a high quality sewing operation.

Meanwhile, in the case that the size of the sewing object increases, the sewing machine needs to be large due to the restriction of the sewing operation region. Hence, it has been requested to develop a sewing machine having a new concept to minimize an installation space of a large pattern sewing machine.

SUMMARY OF THE INVENTION

Accordingly, the present invention has been made to solve the above-mentioned problems occurring in the prior art, and an object of the present invention is to provide a sewing machine capable of implementing a perfect stitch over the entire sections for sewing an airbag, a bag, shoes or the like.

It is another object of the present invention to provide a sewing machine which may sew a large object without using a large sewing machine, thereby minimizing a space to install the sewing machine.

It is still another object of the present invention to provide a sewing machine which may perform a continuous sewing operation on a plurality of sewing objects without changing separate sewing objects by forming a sewing object fixing frame with one or more working regions.

It is yet another object of the present invention to provide a sewing machine which may recognize the information of the sewing object and perform a sewing operation according to the recognized information, when sewing a plurality of sewing objects.

It is further yet another object of the present invention to provide a control method for driving a sewing machine by rotating a head portion and a bed portion in order to implement a perfect stitch over the entire sections for sewing an airbag, a bag, shoes or the like.

In order to accomplish this object, there is provided a sewing machine including: a head portion with a sewing needle reciprocatingly moving upward and downward; a bed portion with a shuttle being rotated simultaneously with upward movement of the sewing needle cooperating to form a stitch; an upper shaft drive motor for reciprocating the sewing needle of the head portion upward and downward; a separate lower shaft drive motor for rotating the shuttle; a sewing machine frame shaped in a box using a plurality of supporting posts and supporting bars to hold the sewing machine; a sewing machine main body mounted on the sewing machine frame; an X-axis transporting means for moving the sewing machine main body mounted on the sewing machine frame in an X direction; a Y-axis transporting means for moving the sewing machine main body mounted on the sewing machine frame in a Y direction; and a sewing object fixing frame provided at the front part of the sewing machine frame on which the sewing object is held, wherein the head portion is disposed at the front end of the sewing machine main body and rotatably installed through a head portion rotating means, and the bed portion is rotatably installed under the head portion through a bed portion rotating means.

The head portion rotating means may include a rotating motor as a drive source (or power source), a reducer installed at the driving shaft of the rotating motor for reducing the rotational speed (number of rotations) of the rotating motor, a driven shaft rotated at a reduced speed state by the reducer, and a sewing head mounted at the driven shaft and rotatable about the driven shaft.

At this time, the reducer may be a bevel gear in which the driving shaft and the driven shaft are intersected at a right angle.

The bed portion rotating means may include a rotating motor as a drive source, a reducer installed at the driving shaft of the rotating motor for reducing the rotational speed of the rotating motor, a driven shaft rotated at a reduced speed state by the reducer, and a sewing bed mounted at the driven shaft.

The reducer may be a bevel gear in which the driving shaft and the driven shaft are met at a right angle.

The rotating motor of the bed portion rotating means may be synchronously operated with respect to a movement of the rotating motor of the head portion rotating means.

The present invention may further include a head portion lifting means for moving the sewing head downward to a working position or upward to a waiting position between the head portion and the sewing machine main body.

The head portion lifting means may include a lifting actuator disposed within the sewing machine main body through a supporting bracket for providing a driving force to move the sewing head upward or downward, and a lifting plate in which the sewing head is coupled at the center of the front part of the lifting plate, a head portion connecting bracket is connected to a driving part of the lifting actuator at the upper end of the rear part of the lifting plate, and a guide means is secured to the opposite ends of the rear part of the lifting plate.

The head portion lifting means may further include a supporting plate in which the guide means is formed at the opposite ends of the front part of the supporting plate and an actuator supporting bracket for supporting the lifting actuator is secured at the center of the rear part of the supporting plate.

In the present invention, the sewing object fixing frame is formed with one or more working regions and the sewing object is supportedly held at each working region.

Here, a plurality of sewing object supporting sashes (hereinafter, referred to as "pallets") for individually holding the sewing object as a working unit is installed on the sewing object fixing frame, such that the sewing object fixing frame has multiple working regions. The pallet is provided with a mark having information to instruct about working methods. The head portion includes a reader (or recognizing device) to read the mark, in which the reader reads the information contained in the mark to apply the information to a control part. The mark may be a bar code, and the reader may be configured as a bar code reader.

In accordance with another aspect of the present invention, there is provided a control method for driving a sewing machine performing a sewing operation wherein a head portion and a bed portion move in an X-axis or Y-axis direction while rotating about a z-axis, the method including the steps of: (a) positioning a sewing needle of the head portion on a sewing plate; (b) operating an X-axis transporting motor, a Y-axis transporting motor, a head portion rotating motor and a bed portion rotating motor according to information inputted in a control part; and (c) returning to step (b) for reiterating the operations when the sewing needle is moved upward and positioned on the sewing plate after the upper and lower shaft drive motors are operated to move the sewing needle downward to form a stitch.

The rotational speed of the upper and lower shaft drive motors may be increased or decreased in proportion to the rotational speed of the X-axis transporting motor, the Y-axis transporting motor, the head portion rotating motor and the bed portion rotating motor.

Furthermore, the head portion rotating motor and the bed portion rotating motor may be operated after the rotational speed of the upper and lower shaft drive motors is lowered.

The rotational speed of the upper and lower shaft drive motors may be controlled according to rotation angles of the head portion and the bed portion.

In accordance with the present invention as discussed above, it should be appreciated that the head portion and the bed portion are rotated to sew the sewing object, which makes it possible to constantly maintain the direction of a thread being sewn, thereby implementing a perfect stitch over the entire section in a sewing machine to sew an airbag, a bag, shoes or the like.

Moreover, since the sewing machine main body may be moved in the X-axis and Y-axis directions, it is possible to sew a large object and minimize the space to install the sewing machine.

In addition, the sewing object fixing frame is formed with one or more working regions, which makes it possible to continuously perform the sewing operation of a plurality of sewing objects without changing separate sewing objects. In this case, it is possible to recognize the information of the sewing object and perform the sewing operation according to the recognized information.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings.

Figure 1:
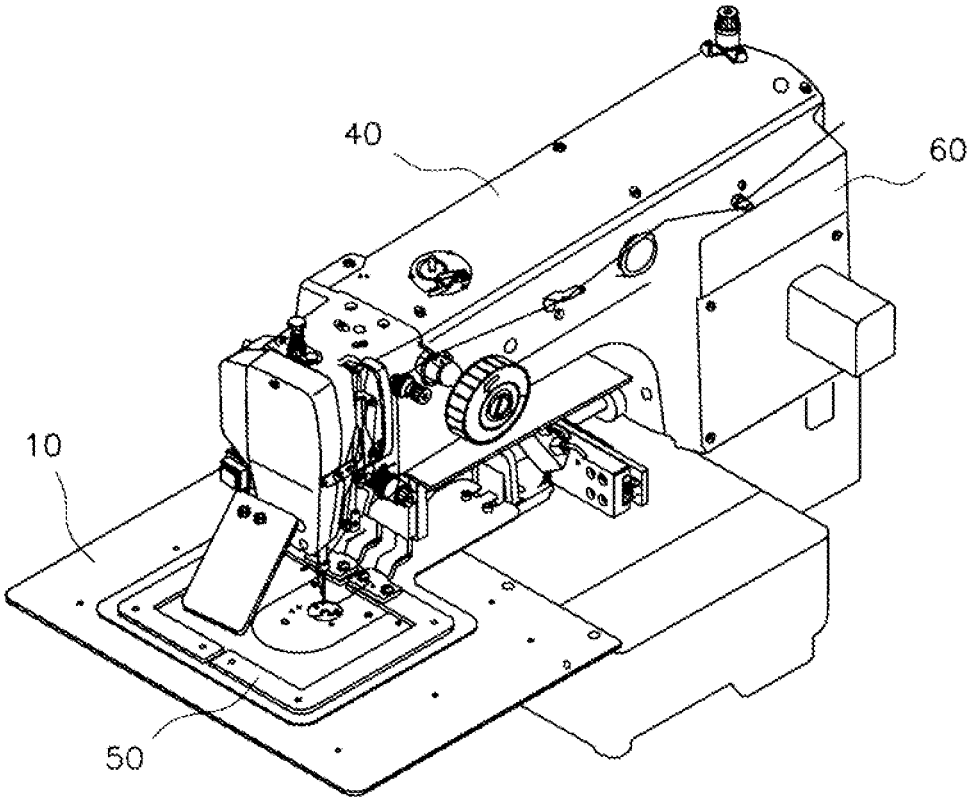
FIG. 1 RELATED ART
FIG. 1 is a perspective view illustrating one example of the conventional sewing machine.
Figure 2A:
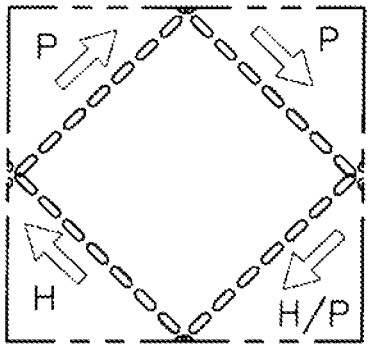
FIG. 2A RELATED ART
FIGS. 2A and 2B are schematic views illustrating each example of occurrence of a hitch stitch in the conventional sewing machine.
Figure 2B:
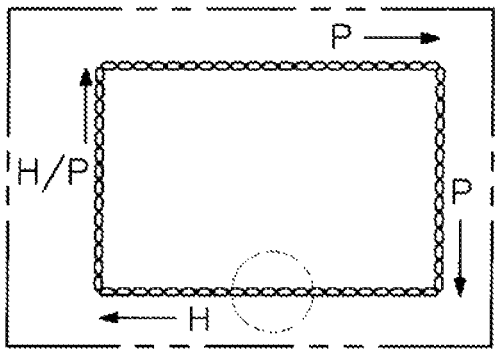
FIG. 2B RELATED ART
Figure 2C:
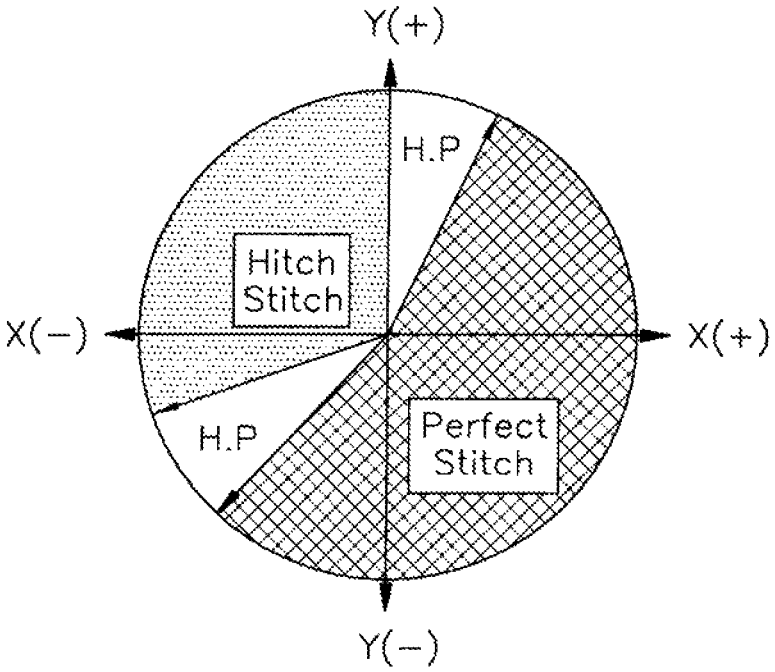
FIG. 2C RELATED ART
FIG. 2C shows an H-P stitch distribution between the stitches after a sewing operation.
Figure 3:
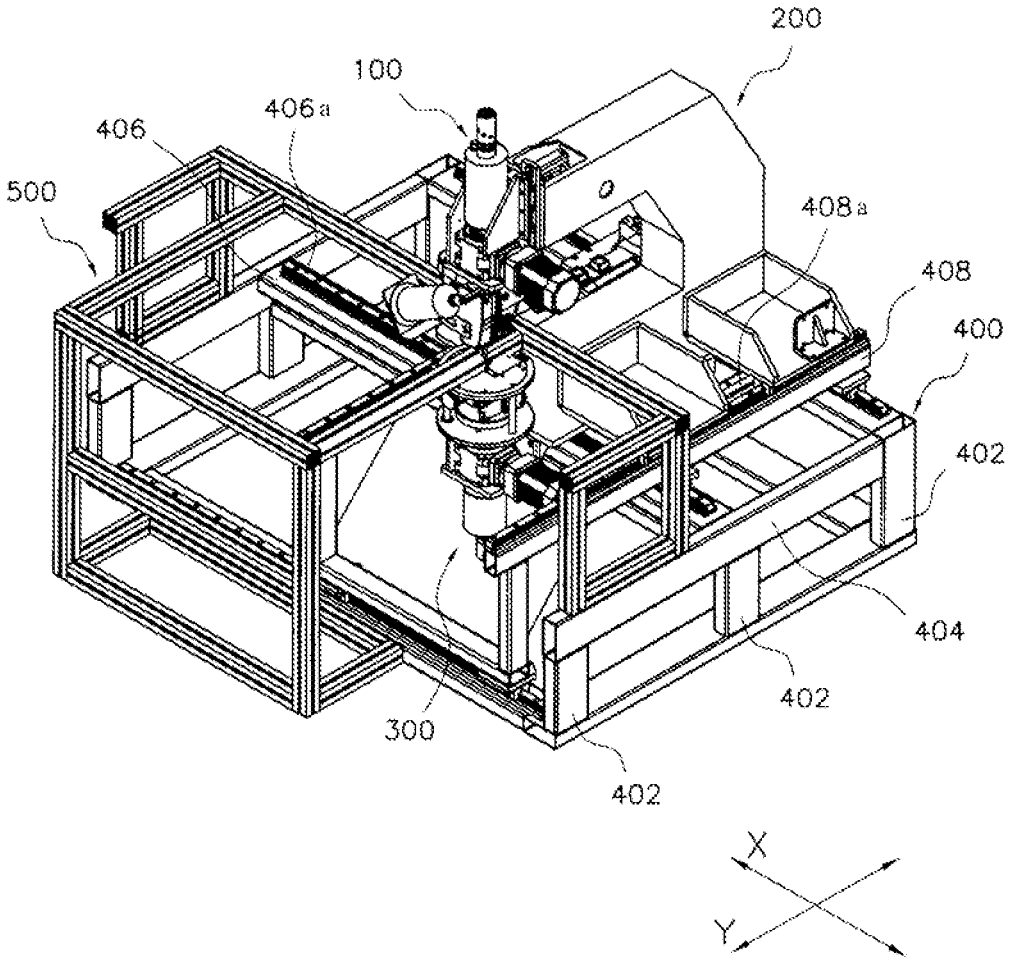
FIG. 3 is a perspective view illustrating a first embodiment of a sewing machine of the present invention having a rotatable head portion.
Figure 4:
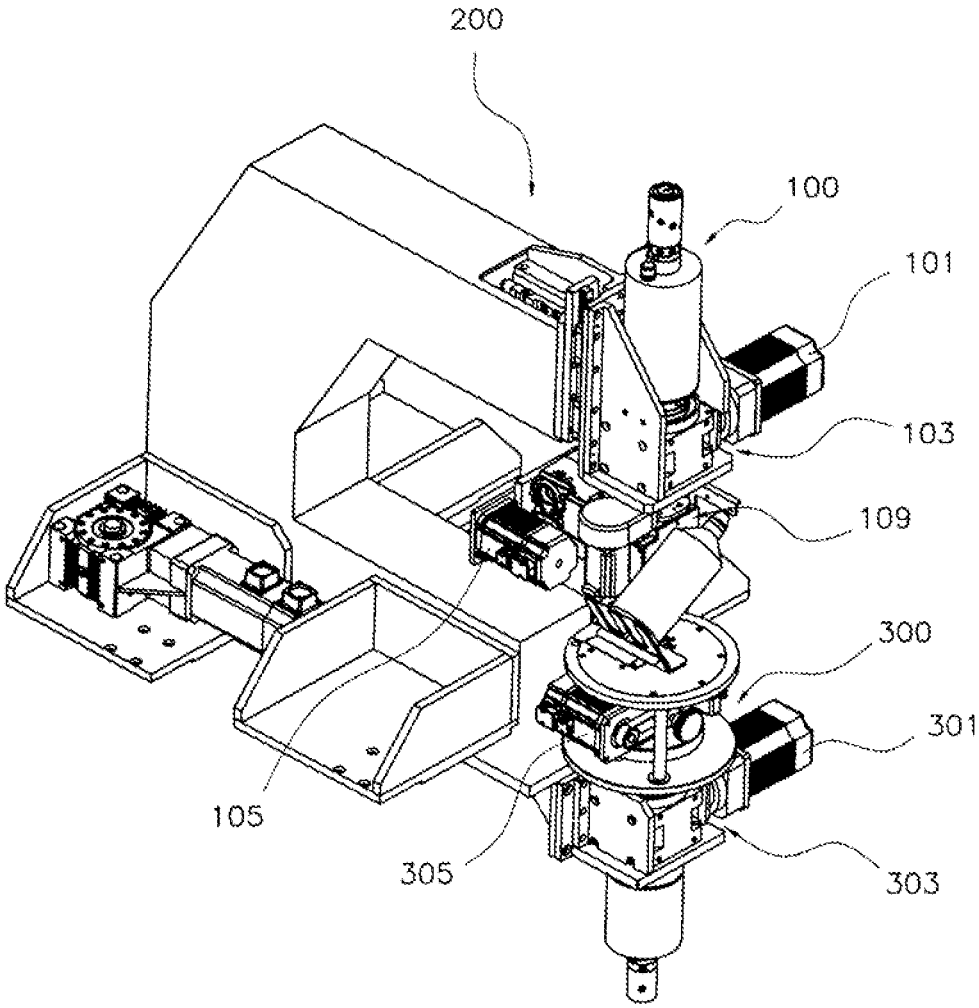
FIG. 4 is a perspective view illustrating an arm portion provided with a head portion and a bed portion of the present invention.
Figure 5:
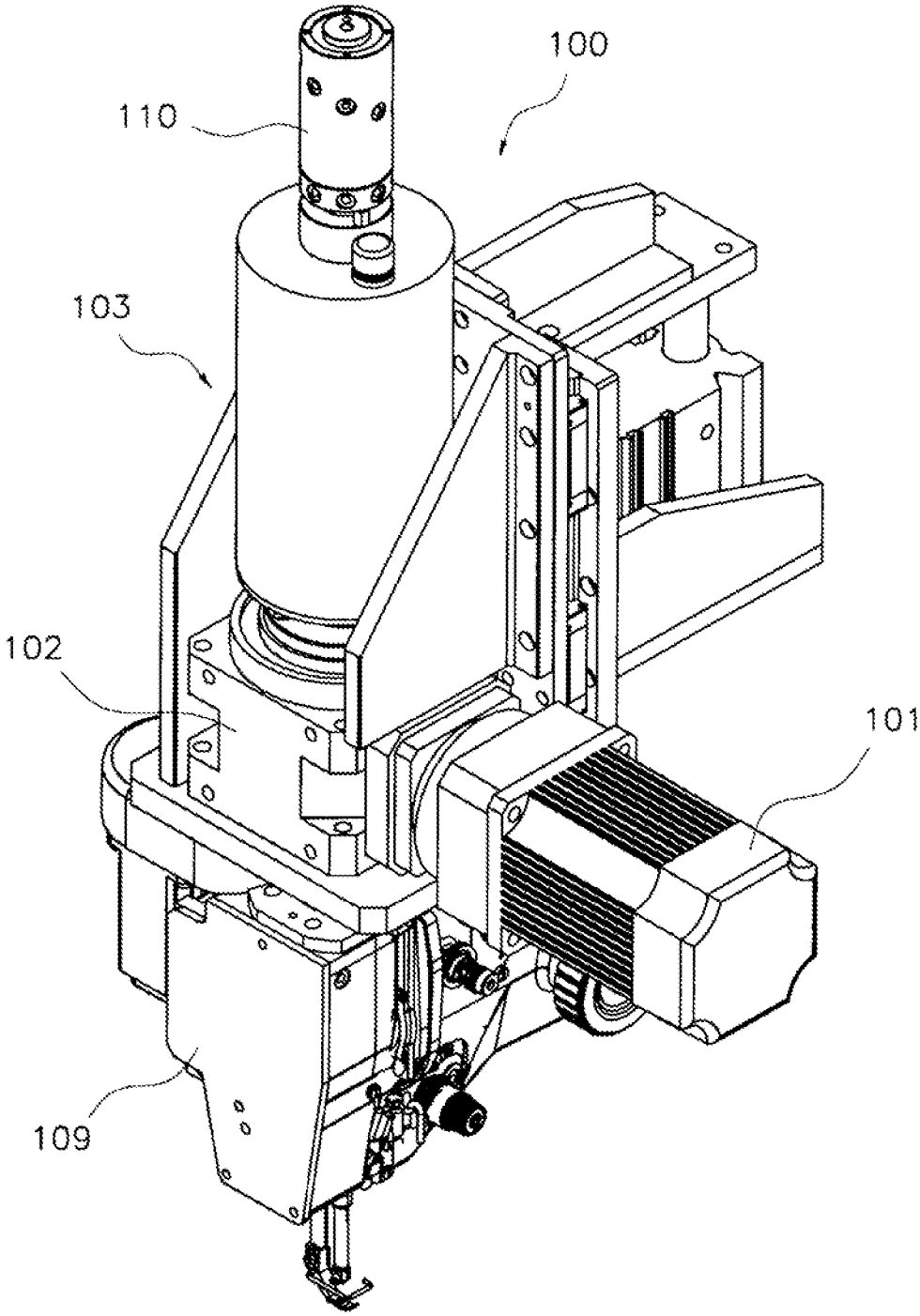
FIG. 5 is a perspective view illustrating the head portion of the present invention.
Figure 6:
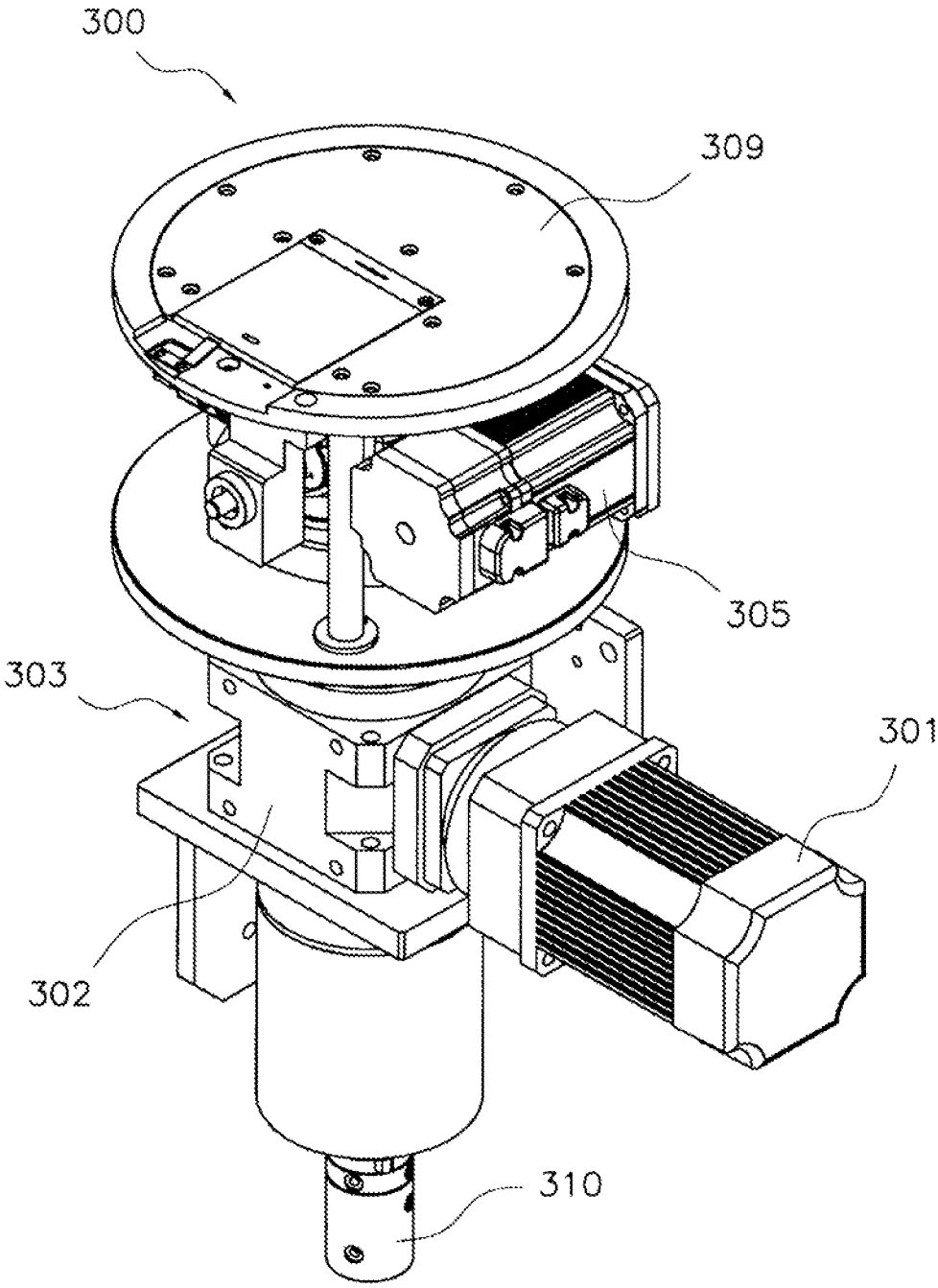
FIG. 6 is a perspective view illustrating the bed portion of the present invention.

FIG. 3 is a perspective view illustrating a first embodiment of a sewing machine of the present invention having a rotatable head portion, FIG. 4 is a perspective view illustrating an arm portion provided with a head portion and a bed portion of the present invention, FIG. 5 is a perspective view illustrating the head portion of the present invention, and FIG. 6 is a perspective view illustrating the bed portion of the present invention.

The sewing machine provided with a rotatable sewing head of the present invention includes a sewing machine frame 400 shaped in a box using a plurality of supporting posts and supporting bars to hold the sewing machine, a sewing machine main body 200 mounted on the sewing machine frame 400, a head portion 100 installed at the front end of the sewing machine main body 200 and provided with a head portion rotating means to rotate a sewing head 109 having a sewing needle which is adapted to be reciprocatingly moved upward and downward in a predetermined range, and a bed portion installed under the head portion 100 and provided with a bed portion rotating means to rotate a sewing bed 309 having a shuttle which is rotated simultaneously with the vertical movement of the cooperating sewing needle to form a stitch.

The sewing machine frame 400 is provide with a plurality of vertical supporting posts 402 and a horizontal supporting bar 404 connecting the supporting posts 402, such that the sewing machine main body 200 is mounted on the sewing machine frame 400.

A sewing object fixing frame 500 to hold a sewing object 510 is provided at the front part of the sewing machine frame 400.

The head portion 100 and the bed portion 300 are provided at the upper part and lower part of the sewing machine main body 200, respectively. The head portion 100 includes a sewing head 109 provided with a sewing needle which reciprocatingly moves upward and downward, an upper shaft drive motor 105 for driving the sewing needle, and a head portion rotating means 103 for rotating the sewing head 109.

Referring to FIGS. 4 and 5, the head portion rotating means 103 includes a rotating motor 101 as a drive source, and a reducer 102 installed at the driving shaft for reducing the rotational speed of the rotating motor 101. Since the reducer 102 is mounted within the head portion, it is not shown in the drawing.

The head portion rotating means 103 includes a driven shaft (not shown) which is rotated at a reduced state by the reducer 102 and a sewing head 109 which is installed at the driven shaft and rotatable about the driven shaft.

The reducer 102 is designed to rotate the sewing head 109 at a reduced speed after reducing the rotational speed of the rotating motor 101. In the illustrated embodiments of the present invention, a bevel gear is adopted for the reducer 102.

The bevel gear adopted as the reducer 102 of the present invention is installed at an angle in which the driving shaft and the driven shaft are perpendicularly intersected, which reduces the rotational speed of the driving shaft to rotate the driven shaft.

Figure 8A:
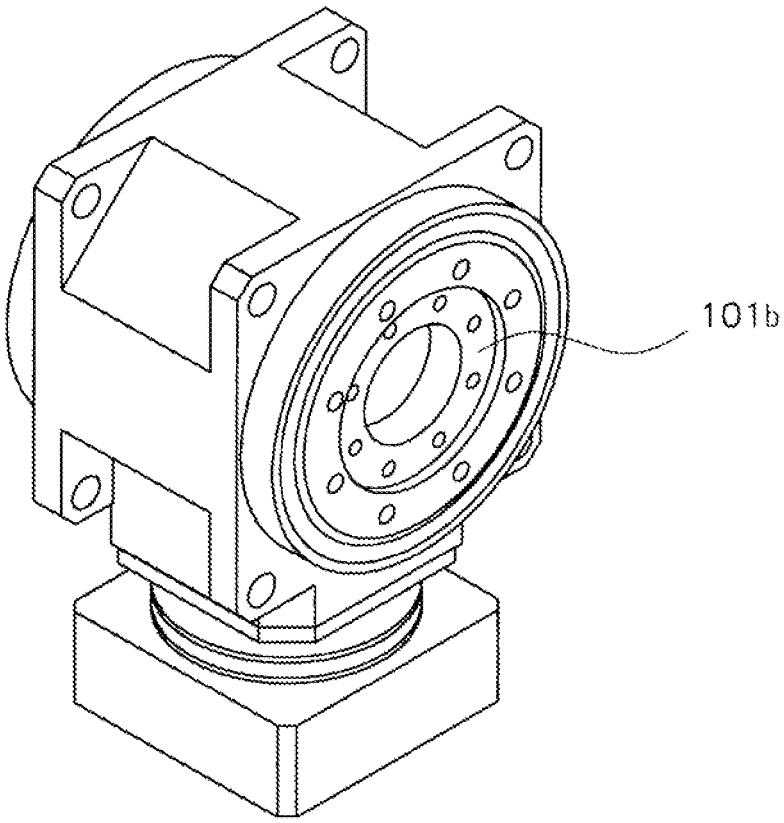
FIGS. 8A and 8B are perspective views illustrating one embodiment of a reducer of the present invention.
Figure 8B:
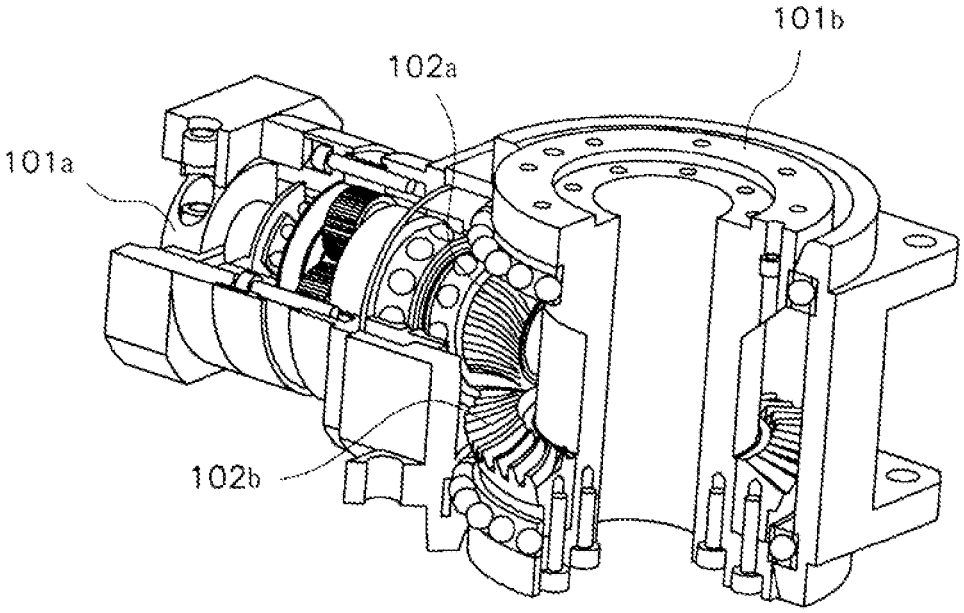

FIGS. 8A and 8B show one embodiment of the reducer of the present invention. An input shaft, i.e., a driving shaft 101*a* of the rotating motor 101 and an output shaft, i.e., a driven shaft 101*b* are met at a right angle. A bevel gear 102*a* mounted on the driving shaft 101*a* and a bevel gear 102*b* of the driven shaft 101*b* which is meshed with the bevel gear 102*a* are, as shown in FIG. 8B, configured to rapidly reduce the rotational speed and output the same.

In the illustrated embodiments of the present invention, a rotation drive gear is adopted as the reducer, which has a back driving function for rotating the output shaft (driven shaft) to drive the input shaft (driving shaft) and a speed reducing function for reducing the rotational speed of the input shaft and then transferring the driving force with a reduced speed to the output shaft, thereby enabling a coaxial and seaming setting of the sewing head 109 and the sewing bed 309.

Meanwhile, the bed portion 300 includes a sewing bed 309, a lower driving motor 305 for driving a shuttle installed at the lower side of the sewing bed 309, and a bed portion rotating means 303 for rotating the sewing bed 309.

The bed portion rotating means 303, as shown in FIG. 6, includes a rotating motor 301 as a drive source, a reducer 302 installed at the driving shaft of the rotating motor 301 to reduce the rotational speed of the rotating motor 301, a driven shaft (not shown) rotated at a reduced speed state by the reducer 302, and a sewing bed 309 rotatably installed at the driven shaft.

The reducer 302 is configured as a bevel gear in which the driving shaft and the driven shaft are intersected at a right angle. The reducer 302 has the same configurations and features as the reducer 102 of the head portion rotating means 103, so a description of the reducer 302 will be omitted.

The reference numerals 110 and 310 in the drawings are slip rings to apply an electric current to the respective rotating motors.

A lower shaft drive motor 305 for driving a lower shaft installed under the sewing bed 309 is synchronously driven with the upper shaft drive motor 105 of the head portion 100. The rotating motor 301 of the bed portion 300 is installed to be driven synchronously with respect to movement of the rotating motor 101 of the head portion 100.

Meanwhile, the sewing machine frame 400 is configured to include an X-axis transporting means and a Y-axis transporting means for moving the sewing machine main body 200 having the head portion 100 and the bed portion 300 in the X-axis and Y-axis directions, respectively.

Figure 14A:
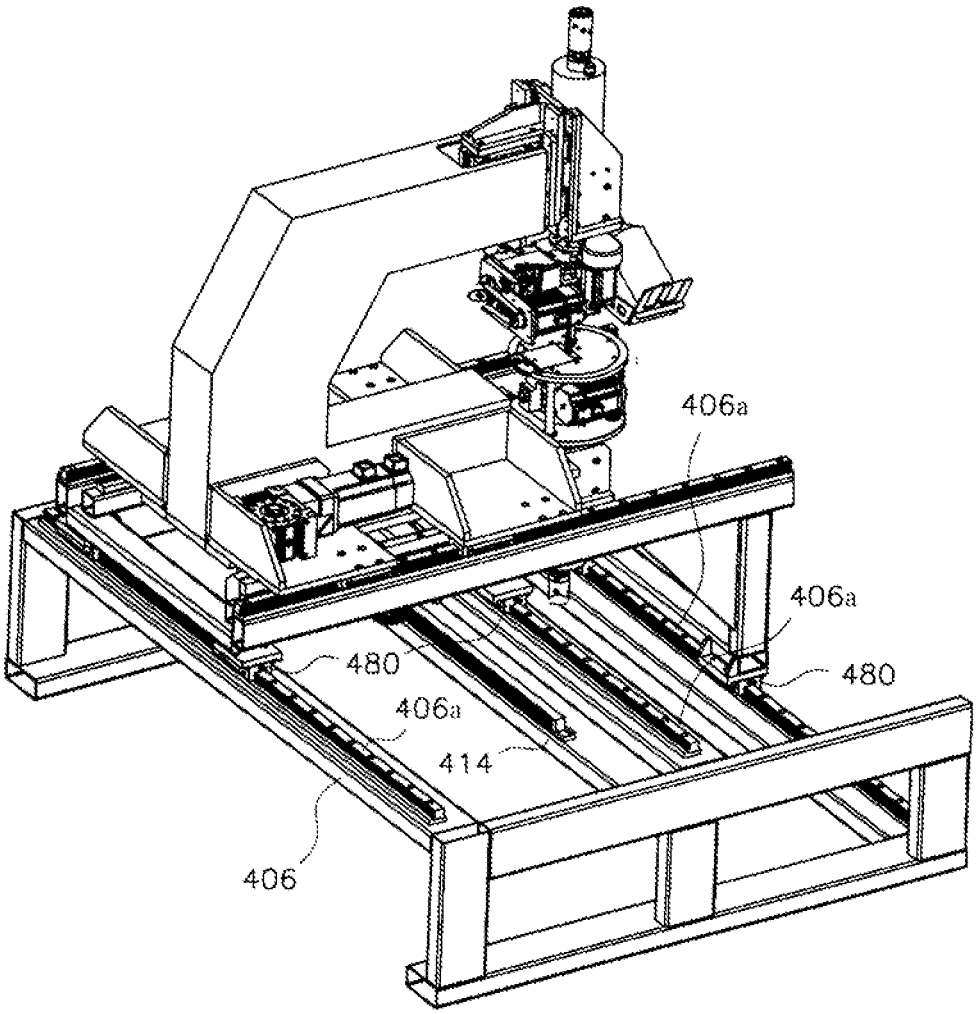
FIG. 14A is a perspective view illustrating a transporting means of the sewing machine of the present invention.
Figure 14B:
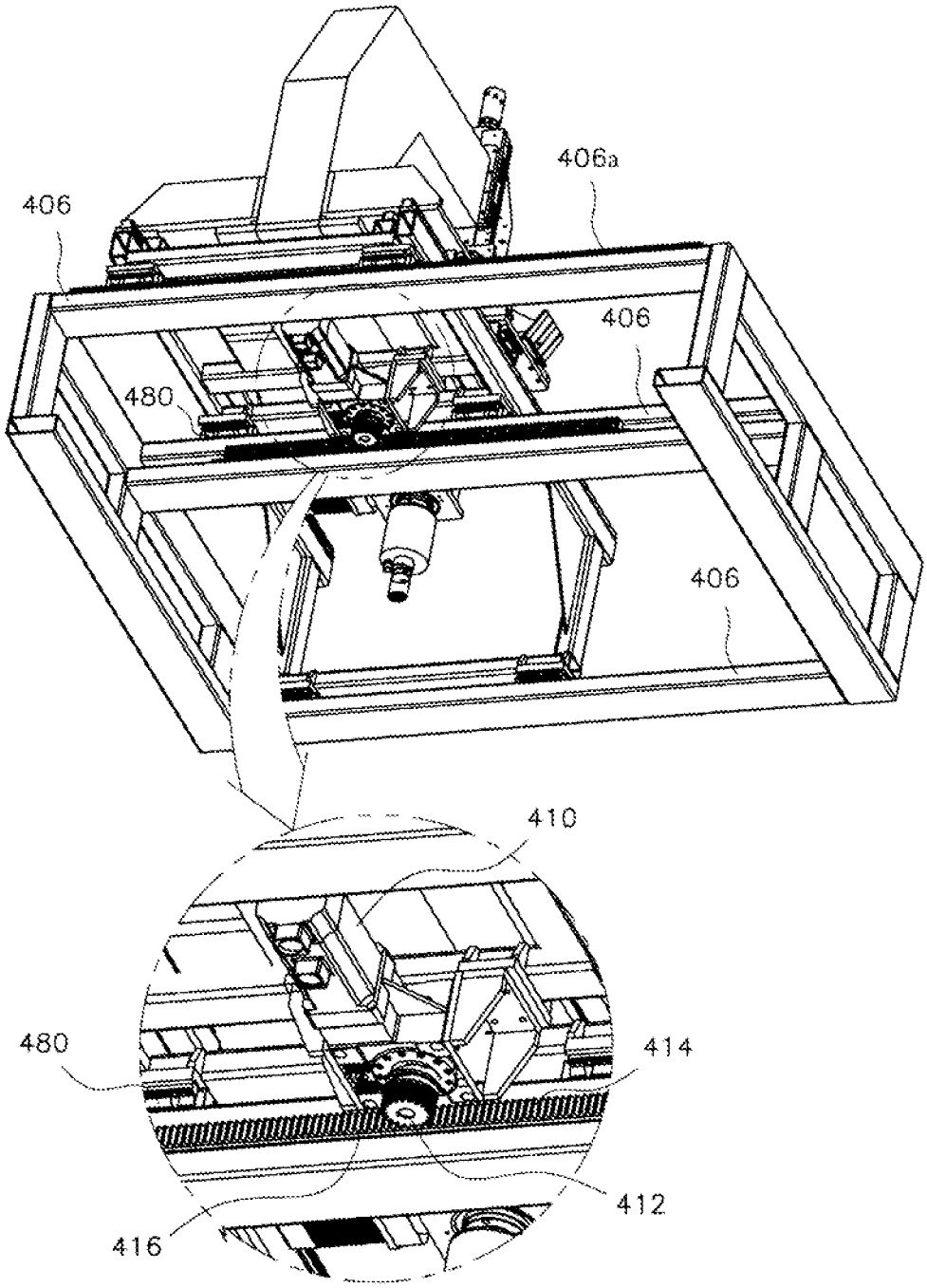
FIG. 14B is a perspective bottom view illustrating an X-axis transporting means of the sewing machine of the present invention.
Figure 15A:
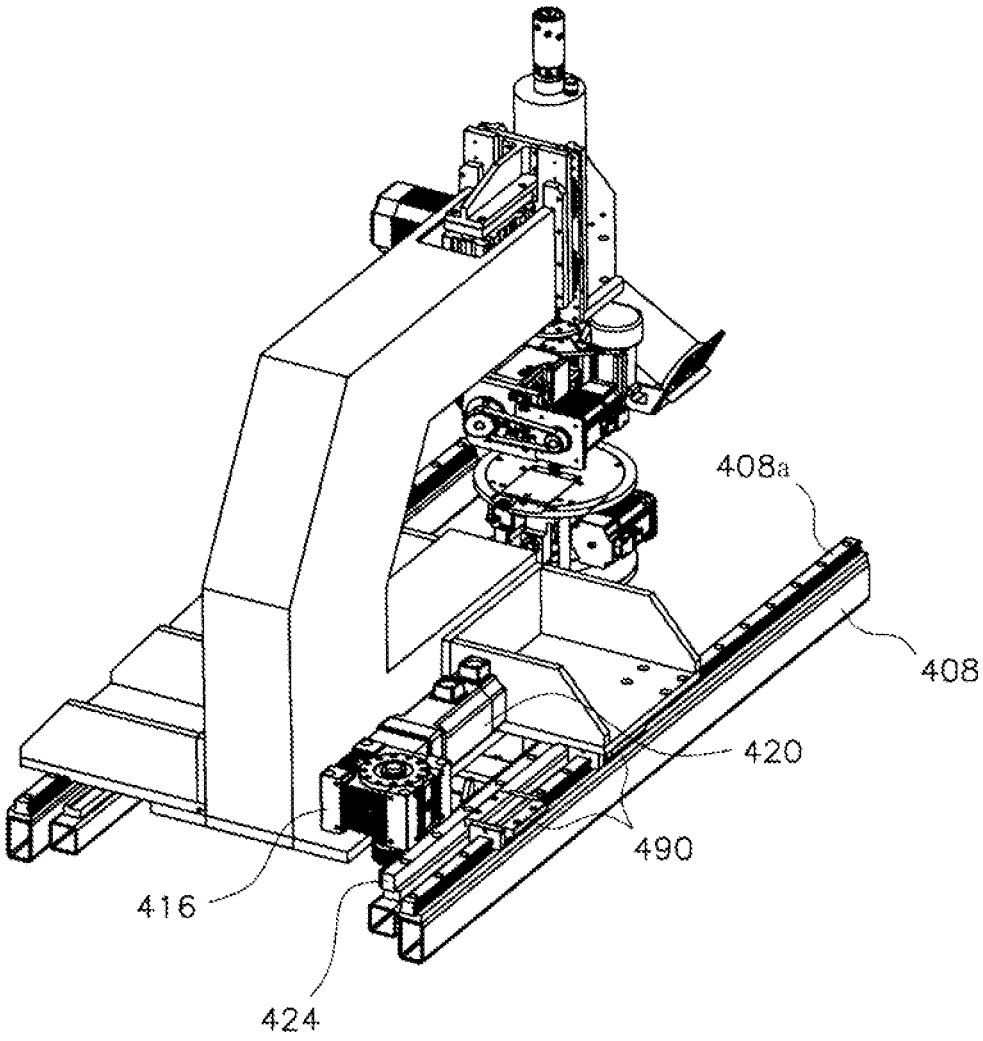
FIG. 15A is a perspective view illustrating a Y-axis transporting means of the sewing machine of the present invention.
Figure 15B:
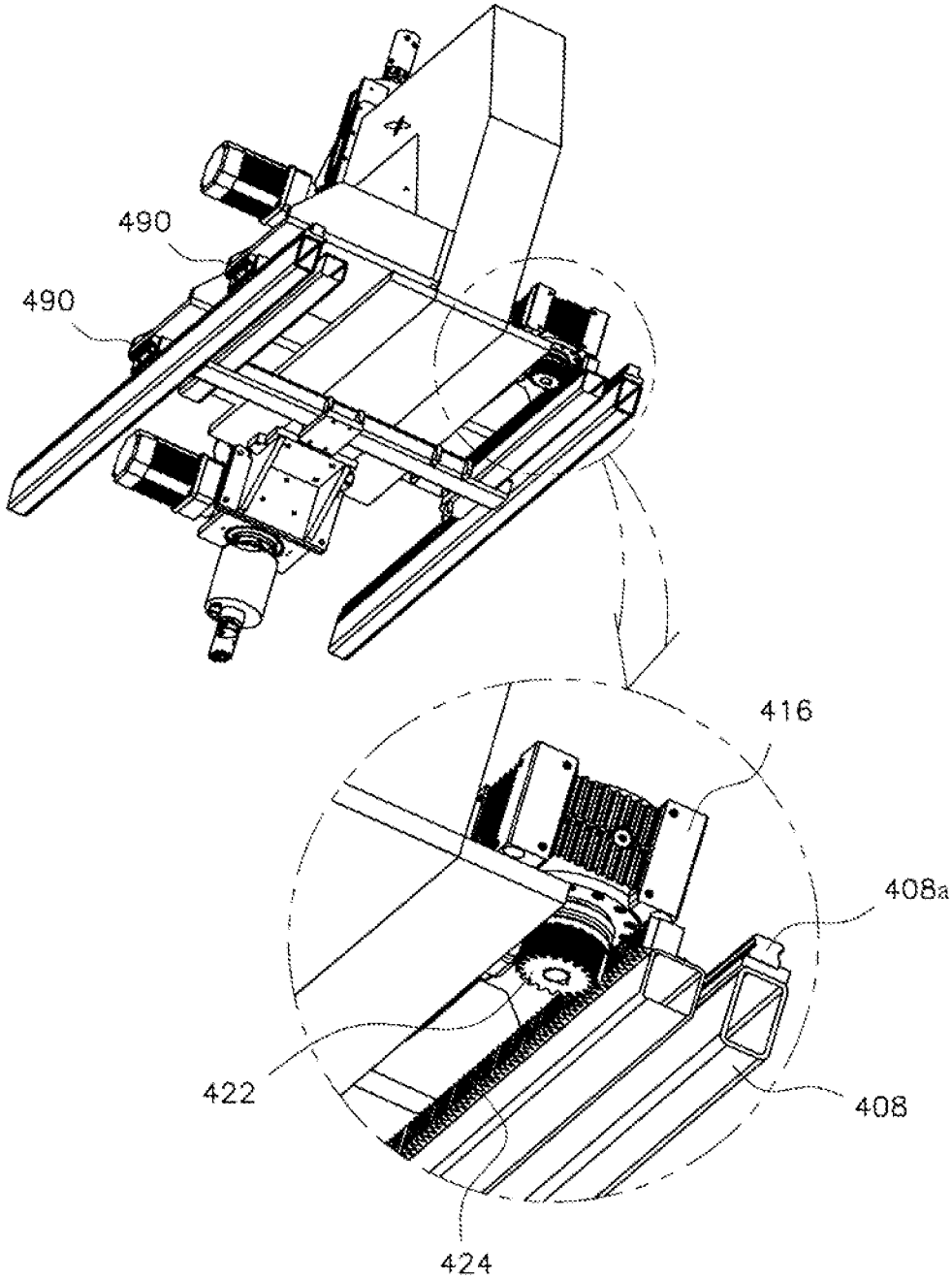
FIG. 15B is a perspective bottom view illustrating the Y-axis transporting means of the sewing machine of the present invention.

Hereinafter, the X-axis transporting means and Y-axis transporting means will be described mainly with reference to FIGS. 3, 14A, 14B, 15A, and 15B. FIGS. 14A and 14B are perspective views illustrating the X-axis transporting means of the sewing machine and perspective bottom views of its major parts, and FIGS. 15A and 15B are perspective views illustrating the Y-axis transporting means of the sewing machine and perspective bottom views of its major parts.

The X-axis transporting means is provided in the X-axis direction of the sewing machine frame 400 to cause the sewing machine main body 200 to be displaceable in the X-axis direction, i.e., leftward and rightward directions. In contrast, the Y-axis transporting means is provided in the Y-axis direction of the sewing machine frame 400 to allow the sewing machine main body 200 to be movable in the Y-axis direction, i.e., forward and rearward direction.

The X-axis transporting means and Y-axis transporting means may be implemented with known configurations. In the illustrated embodiments of the present invention, the X-axis transporting means includes an X-axis frame 406 extending in the X-axis direction, a first guide rail 406*a* installed at the X-axis frame 406, a first guide block 480 coupled with the first guide rail 406*a* for transporting the sewing machine main body 200 in the X-axis direction, an X-axis transporting motor 410 displaceably mounted along the first guide rail 406*a* for applying a driving force as a drive source to transport the sewing machine main body 200 in the X-axis direction, a first driving pinion 412 rotatably connected to the driving shaft of the X-axis transporting motor 410, and a first rack gear 414 fixedly installed along the extension direction of the X-axis frame 406 and engaged with the first driving pinion 412.

The rotational speed of the X-axis transporting motor 410 may be reduced by a third reducer 416 to increase the output torque of the X-axis transporting motor 410.

The Y-axis transporting means according to the illustrated embodiments of the present invention includes an Y-axis frame 408 extending in the Y-axis direction, a second guide rail 408*a* installed in the extension direction of the Y-axis frame 408, a second guide block 490 coupled with the second guide rail 408*a* for transporting the sewing machine main body 200 in the Y-axis direction, an Y-axis transporting motor 420 movably mounted along the second guide rail 408*a* for applying a driving force as a drive source to transport the sewing machine main body 200 in the Y-axis direction, a second driving pinion 422 rotatably connected to the driving shaft of the Y-axis transporting motor 420, and a second rack gear 424 fixedly installed along the extension direction of the Y-axis frame 408 and engaged with the second driving pinion 422.

The rotational speed of the Y-axis transporting motor 420 may be also reduced by a fourth reducer 416 to increase the output torque of the Y-axis transporting motor 420.

It is preferable to provide a head portion lifting means 210 for moving the sewing head 109, which is provided with the sewing needle reciprocatingly moving upward and downward between the head portion 100 and the sewing machine main body 200, upward to a working position or downward to a waiting position.

Figure 7:
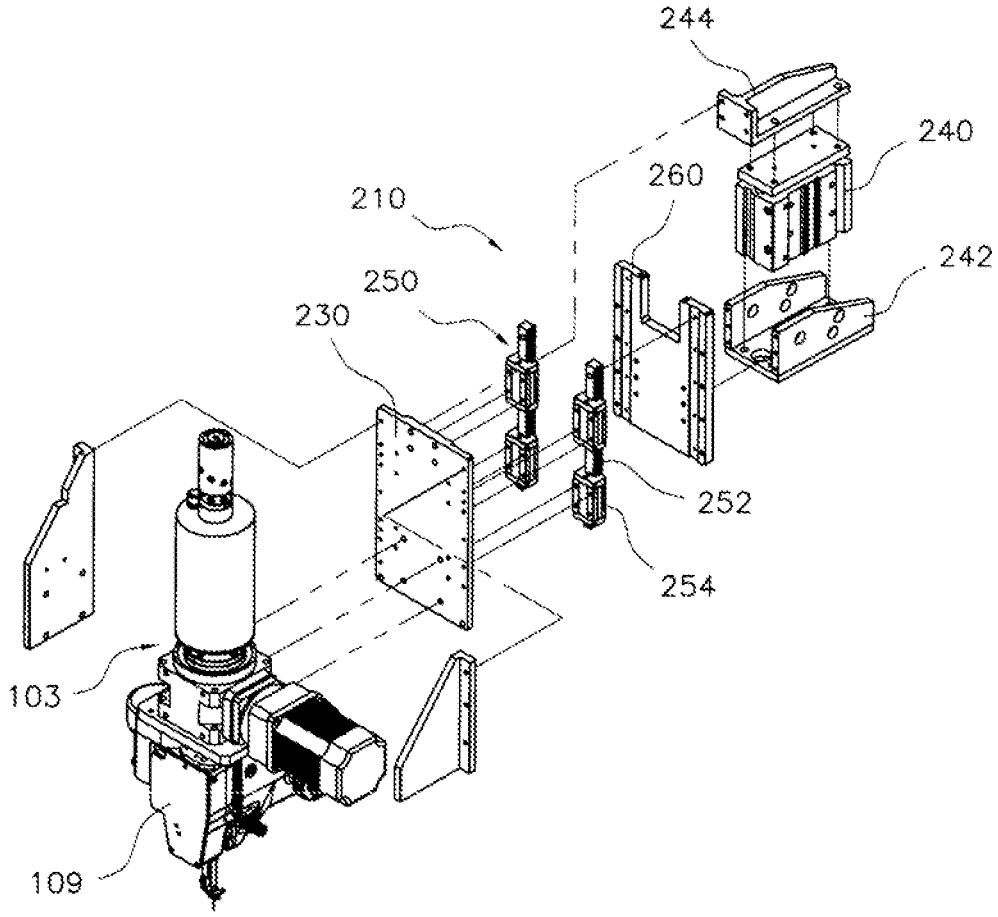
FIG. 7 is an exploded perspective view illustrating a head portion lifting means of the present invention.

Referring to FIG. 7, the head portion lifting means 210 includes a lifting actuator 240 disposed within the sewing machine main body 200 through an actuator supporting bracket 242 for providing a driving force to move the sewing head 109 upward and downward, and a lifting plate 230 in which the sewing head 109 is coupled to the center of the front part of the lifting plate and simultaneously a head portion connecting bracket 244 coupled to the driving part of the lifting actuator is connected to the upper end of the rear part of the lifting plate 230.

The opposite lateral ends of the rear part of the lifting plate 230 are fixedly secured to a guide means 250 such as a guide rail 252 and a guide coupling member 254 for a stable, reliable lifting drive movement of the lifting plate 230, respectively.

The guide means 250 is coupled to the opposite lateral ends of the front part of a supporting plate 260 which is secured within the sewing machine main body 200, and the actuator supporting bracket 242 for supporting the lifting actuator 240 within the sewing machine main body 200 is secured to the center of the rear part of the supporting plate 260.

The head portion lifting means 210 is configured in such a way that upon actuation of the lifting actuator 240 the head portion connecting bracket 244 connected to the driving part of the lifting actuator 240 is driven to move, and therefore the lifting plate 230 connected to the front end of the head portion connecting bracket 244 is moved along the guide means 250, thereby causing the sewing head 109 coupled at the front part of the lifting plate 230 to move upward and downward.

Operations of a sewing machine configured above in accordance with the present invention will be illustrated hereinafter.

If a sewing start switch (not shown) is turned on to perform a sewing operation, the head portion 100 moves down and then the upper shaft drive motor 105 of the head portion is activated. At this moment, the lower shaft drive motor 305 of the bed portion 300 is synchronously driven with the upper shaft drive motor 105 of the head portion 100.

In order to perform a sewing operation in a circular, curved, inclined line or the like, if the head portion rotating motor 101 is actuated, the sewing head 109 is rotated at a reduced speed by the reducer 102.

At this point, since the bed portion rotating motor 301 is moved synchronously with respect to movement of the head portion rotating motor 101, the sewing bed 309 is also rotated.

As such, it may be appreciated that since the sewing head 109 and the sewing bed 309 perform the sewing operation while being rotated, the quality of the sewing operation is improved due to the change of a rotation angle.

In other words, since the upper shaft drive motor 105 and the lower shaft drive motor 305 begin to rotate after the sewing head 109 and the sewing bed 309 are completely rotated through the head portion rotating motor 101 and the bed portion rotating motor 301, respectively, the direction of the thread being sewn may be maintained in a constant direction, which makes it possible to implement a perfect stitch over the entire section in the sewing machine for sewing an airbag, a bag, shoes or the like.

Control methods for driving the aforementioned sewing machine will be illustrated hereinafter.

In a state that the sewing needle of the head portion 100 is positioned over the sewing plate, the X-axis transporting motor 410, the Y-axis transporting motor 420, the head portion rotating motor 101 and the bed portion rotating motor 301 are actuated in accordance with the information inputted in the control part.

The reason that the X-axis transporting motor 410, the Y-axis transporting motor 420, the head portion rotating motor 101 and the bed portion rotating motor 301 are designed to be actuated only when the sewing needle is positioned over the sewing plate is for safety in use. Here, it may be noted that a known sensing means may be used as a needle position sensing means for detecting whether the sewing needle is positioned over the sewing plate.

Then, the upper shaft drive motor 105 and the lower shaft drive motor 305 are actuated to move the sewing needle downward for forming a stitch, and thereafter when the sewing needle moves upward to be positioned over the sewing plate, the X-axis transporting motor 410, the Y-axis transporting motor 420, the head portion rotating motor 101 and the bed portion rotating motor 301 are in turn actuated to reiterate such operations.

Here, it is possible to control the rotational speed of the X-axis transporting motor 410, the Y-axis transporting motor 420, the head portion rotating motor 101 and the bed portion rotating motor 301 depending upon the rotational speed of the upper shaft drive motor 105 which moves the sewing needle upward and downward. In a usual case, the rotational speed is, in general, controlled proportionally and more particularly controlled in a linear proportional manner. As aforementioned, since the lower shaft drive motor 305 is synchronized with the upper shaft drive motor 105 and driven at the same time, explanations of its operation will be omitted.

When the head portion 100 and the bed portion 300 are abruptly rotated during a high speed stitching, there arises a problem that the stitching work is not performed smoothly or a stress is applied to the related components. Therefore, before the head portion 100 and the bed portion 300 are rotated, it is possible to reduce the rotational speed of the upper shaft drive motor 105 to a certain range, for example, before 5-10 stitches from the moment of its rotating. Alternatively, it may be possible to temporarily stop the upper shaft drive motor 105 when needs arise.

Moreover, the rotational speed of the upper shaft drive motor 105 may be controlled according to the rotation angle of the head portion 100 and the bed portion 300. If the rotational speed of the upper shaft drive motor 105 is large, it takes less time for the rotating motors 101 and 301 to move to the determined angle. Hence, it is desirable that the rotation angle of the rotating motor is inversely proportional to the rotational speed of the upper shaft drive motor 105. For example, when the rotation angle is over 30 degrees, the rotational speed of the upper shaft drive motor 105 is first lowered to 0-100 rpm and then the rotating motor 101 and 301 is activated. When the rotating motors 101 and 301 are not activated or rotated below the determined angle, the rotational speed of the upper shaft drive motor 105 may be automatically returned to the normal level.

Figure 9:
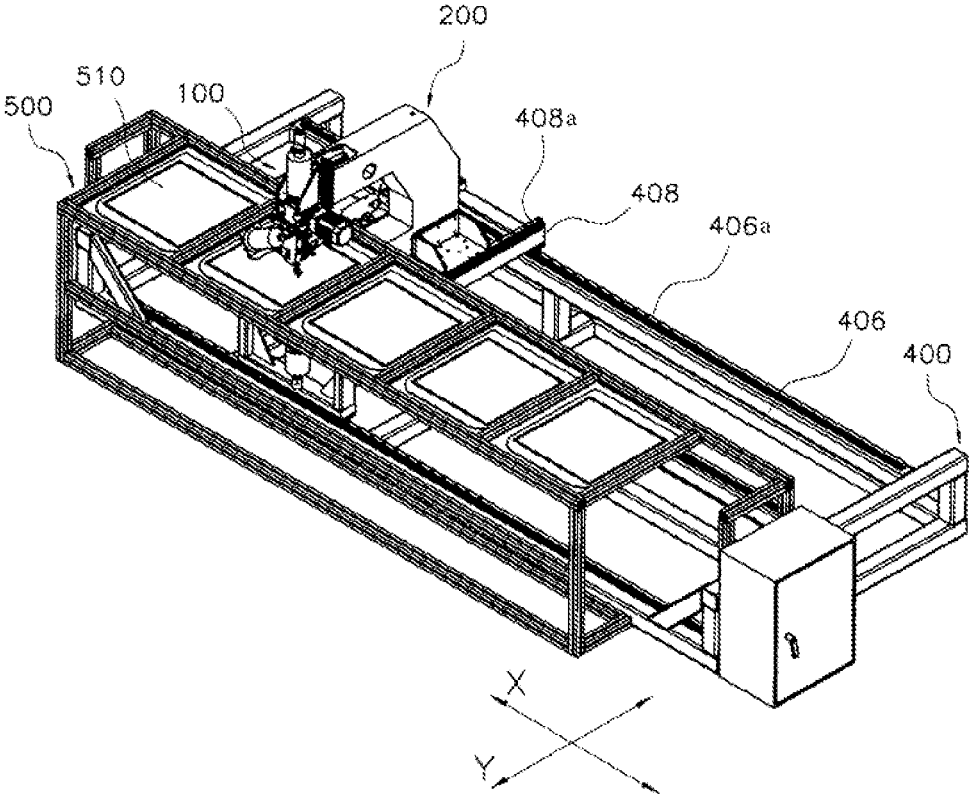
FIG. 9 is a perspective view illustrating a second embodiment of the sewing machine of the present invention.

FIG. 9 shows a perspective view of a sewing machine in accordance with the second embodiment of the present invention. A sewing object fixing frame 500 provided at the front part of a sewing machine frame 400 on which a sewing object 510 is held, as shown in FIG. 3, is formed with one working region to perform a sewing operation on the sewing object 510. After the sewing operation of the sewing object is finished, the sewing object fixing frame 500 is adapted to receive another sewing object 510 to be replaced and held thereon. As shown in FIG. 9, the sewing object fixing frame 500 is formed with one or more working regions, so that a plurality of sewing objects 510 or different kinds of sewing objects 510 are fixedly placed at the respective working regions, and then the sewing machine main body 200 after completion of one kind of sewing operation at the one working region may move to another working region to continuously perform the sewing operation without a separate replacement of the sewing object 510.

As shown in FIG. 9, it may be noted that five working regions are arranged in series along the X-axis direction. After the sewing machine main body 200 is transported along the X-axis direction, the sewing machine will perform the sewing operation being assigned.

Figure 10:
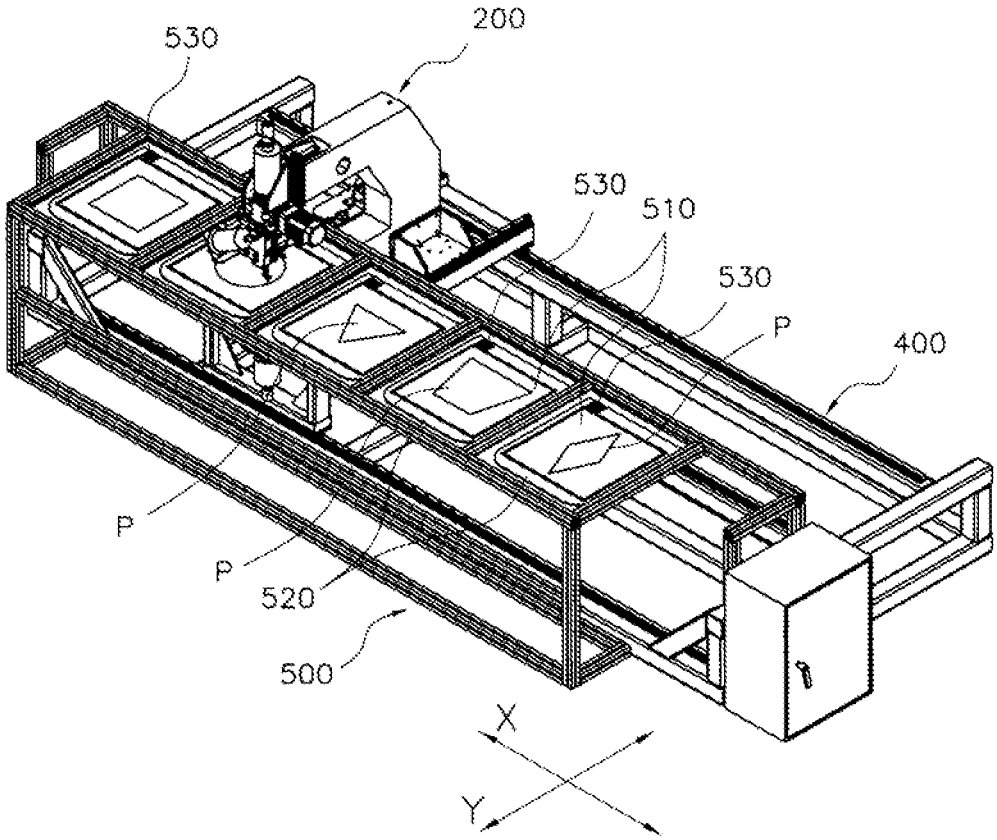
FIG. 10 is a perspective view illustrating a third embodiment of the sewing machine of the present invention.
Figure 11:
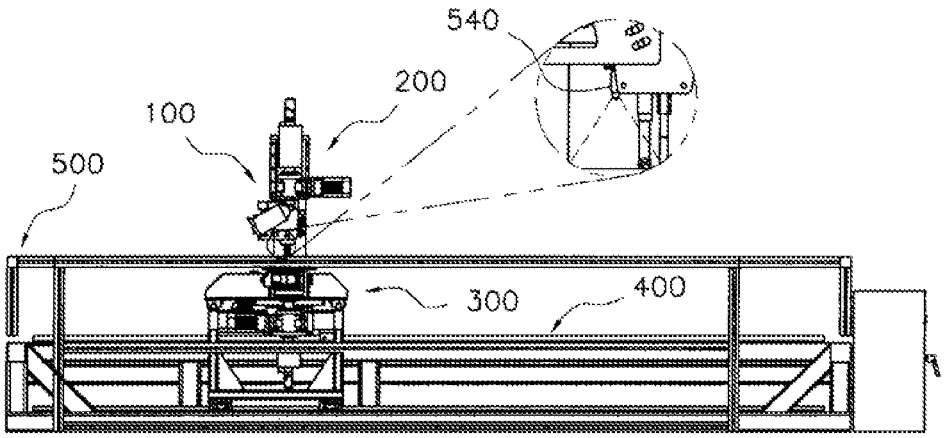
FIG. 11 is a front view illustrating a major portion of the third embodiment of the sewing machine of the present invention.
Figure 12:
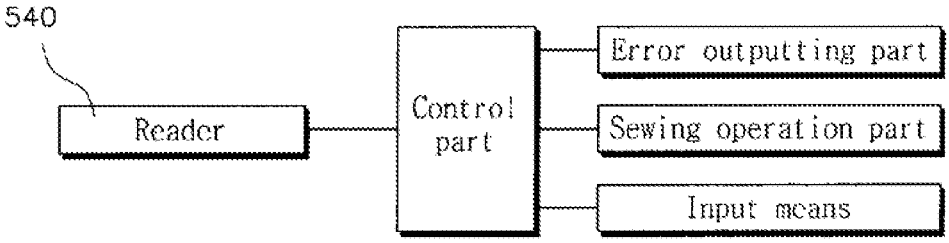
FIG. 12 is a block diagram illustrating a bar code information processing unit in accordance with the third embodiment of the sewing machine of the present invention.
Figure 13:
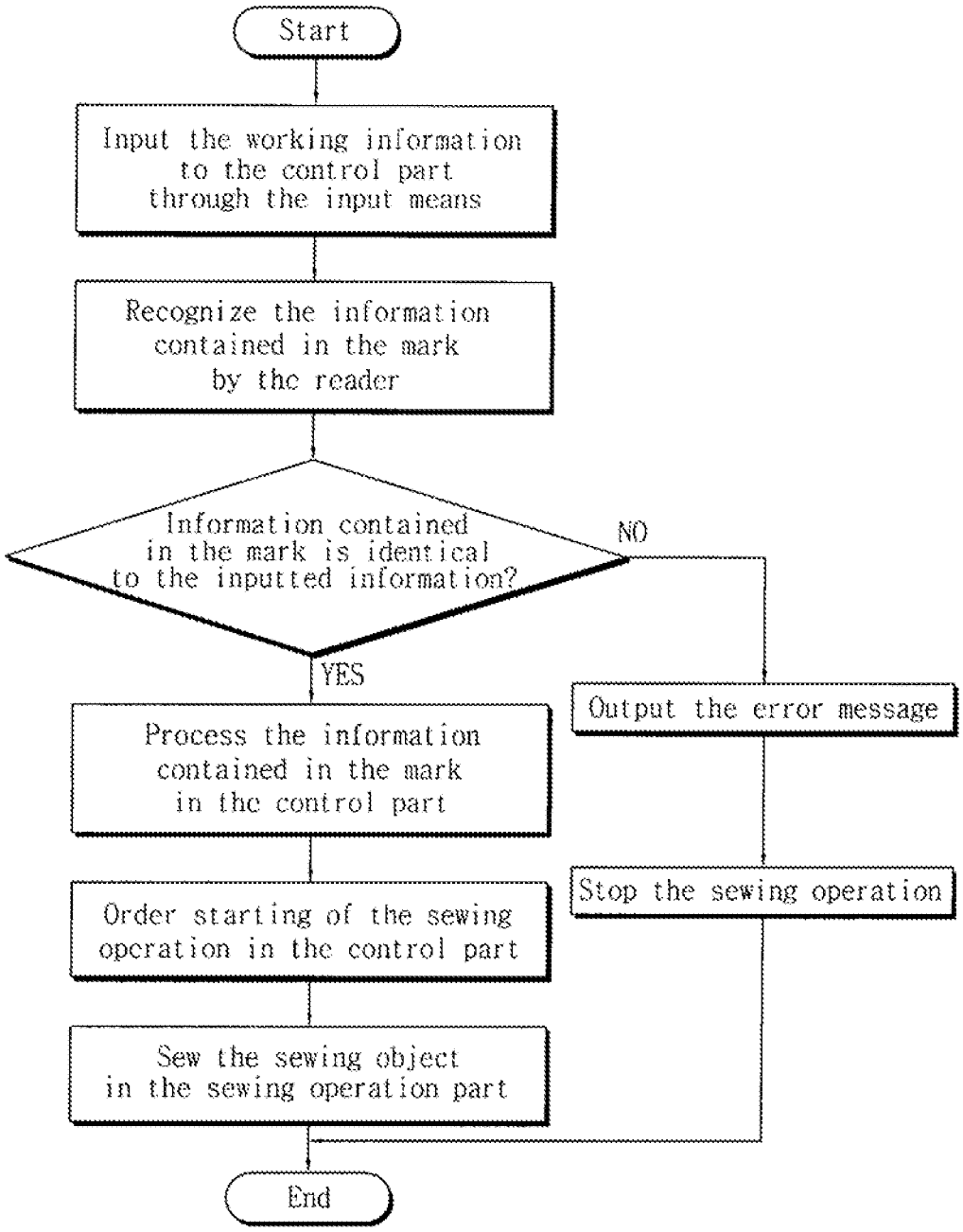
FIG. 13 is a flow chart illustrating the bar code information processing of the bar code information processing unit of FIG. 12.

FIG. 10 is a perspective view illustrating a third embodiment of the sewing machine of the present invention, FIG. 11 is a front view illustrating a major portion of the third embodiment of the sewing machine of the present invention, FIG. 12 is a block diagram illustrating a bar code information processing unit in accordance with the third embodiment of the sewing machine of the present invention, and FIG. 13 is a flow chart illustrating bar code information processing of the bar code information processing unit of FIG. 12.

The third embodiment of the present invention has multiple working regions in which a plurality of pallets 520 for individually holding each sewing object 510 as a working unit are mounted on the sewing object fixing frame 500.

The pallet 520 is provided with a mark 530 which has information for instructing about sewing patterns, sewing information and working methods, and the head portion 100 is provided with a reader 540 to read the mark 530.

The reader 540 is designed to read the information contained in the mark 530 and apply the same to a control part. The subject of the information in the mark 530 will be how to perform the sewing operation with what patterns and methods to be adopted.

The information to be contained in the mark may be configured to substantially include a variety of information besides the aforementioned sewing patterns and working methods. For example, the mark may contain information on how many sewing objects remain, how many sewing objects may be sewn in the same pattern without referencing the mark, to what speed the stitching speed has to be reduced in the case of hard or thick materials or the like.

With the help of using the mark 530 and the reader 540, it is possible to sew each sewing object 510 with a different pattern (P) as shown in FIG. 10, which will contribute to improving productivity of the sewing object in the current market searching for small quantities but various kinds of goods.

Meanwhile, using the mark 530 and the reader 540 of the mark 530 will lead to an effect to detect work errors in advance as follows.

As shown in FIGS. 12 and 13, before the sewing operation, a worker inputs information on the pattern and the working method about the sewing object to the control part through an input means or wired or wireless communication means. The information contained in the mark 530 is read by the reader 540 and then compared with the information on the pattern and the working method which have been already inputted to the control part before the sewing operation. If both of the information is identical to each other, the sewing operation proceeds through the sewing operation part. In contrast, if both of the information are different from each other, an error signal is generated through an error outputting part and notifies of this to the worker.

For instance, before the sewing operation, the worker inputs and stores information on the pattern and the working method to the control part through the wired or wireless communication means. When the working information contained in the mark 530 attached to the pallet 520 being fed is different from those stored in the control part of the sewing machine, the error signal is outputted to alarm the worker to stop the sewing operation.

At this point, alternatively, when the working information stored in the control part of the sewing machine differs from the working information contained in the mark 530 of the pallet 520, it is possible to skip only the corresponding sewing object and transport the sewing machine main body 200 to the next pallet 520 for continuing the subsequent sewing operation. This may remove the possibility of damaging the expensive work material to be sewn due to forcibly performing of the wrongful operation different from the intent of the worker.

As aforementioned in detail, the mark 530 available in the present invention may be selected depending upon the needs from numerous methods, such as a number, color, a punched card, a bar code, an RFID card etc.

According to this embodiment, a bar code, which is cheap as well as is capable of containing various information therein, is used. Hence, the reader 540 will be a bar code reader as shown in FIG. 11.

Furthermore, according to another embodiment of the present invention, there may be further provided a supporting sash mounting detecting means for detecting whether the pallet 520 is correctly mounted at a right place on the sewing object fixing frame 500. Here, a proximity sensor or a resistance sensor may be optionally used as a supporting sash mounting detecting means.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A sewing machine comprising:

a head portion with a sewing needle reciprocatingly moving upward and downward;

a bed portion with a shuttle being rotated simultaneously with upward movement of the sewing needle cooperating to form a stitch;

an upper shaft drive motor for reciprocating the sewing needle of the head portion upward and downward;

a separate lower shaft drive motor for rotating the shuttle;

a sewing machine frame shaped in a box using a plurality of supporting posts and supporting bars to hold the sewing machine;

a sewing machine main body mounted on the sewing machine frame;

an X-axis transporting means for moving the sewing machine main body mounted on the sewing machine frame in an X direction;

a Y-axis transporting means for moving the sewing machine main body mounted on the sewing machine frame in a Y direction; and a sewing object fixing frame provided at the front part of the sewing machine frame on which the sewing object is held, wherein the head portion is disposed at the front end of the sewing machine main body and rotatably installed through a head portion rotating means, and the bed portion is rotatably installed under the head portion through a bed portion rotating means.

2. The sewing machine as claimed in claim 1, wherein the head portion rotating means comprises:

a rotating motor as a drive source;

a reducer installed at the driving shaft of the rotating motor for reducing the rotational speed of the rotating motor;

a driven shaft rotated at a reduced speed state by the reducer; and a sewing head mounted at the driven shaft and rotatable about the driven shaft.

3. The sewing machine as claimed in claim 2, wherein the reducer comprises a bevel gear in which the driving shaft and the driven shaft intersect each other at a right angle.

4. The sewing machine as claimed in claim 1, wherein the bed portion rotating means comprises:

a rotating motor as a drive source;

a reducer installed at the driving shaft of the rotating motor for reducing the rotational speed of the rotating motor;

a driven shaft rotated at a reduced speed state by the reducer; and a sewing bed mounted at the driven shaft.

5. The sewing machine as claimed in claim 4, wherein the reducer comprises a bevel gear in which the driving shaft and the driven shaft intersect each other at a right angle.

6. The sewing machine as claimed in claim 1, wherein the rotating motor of the bed portion rotating means is synchronously operated with respect to a movement of the rotating motor of the head portion rotating means.

7. The sewing machine as claimed in claim 1, further comprising a head portion lifting means for moving the sewing head downward to a working position or upward to a waiting position between the head portion and the sewing machine main body.

8. The sewing machine as claimed in claim 7, wherein the head portion lifting means comprises:

a lifting actuator disposed within the sewing machine main body through a supporting bracket for providing a driving force to move the sewing head upward or downward; and a lifting plate in which the sewing head is coupled at the center of the front part of the lifting plate, a head portion connecting bracket is connected with a driving part of the lifting actuator at the upper end of the rear part of the lifting plate, and a guide means is secured to the opposite ends of the rear part of the lifting plate.

9. The sewing machine as claimed in claim 8, wherein the head portion lilting means further includes a supporting plate in which the guide means is formed at the opposite ends of the front part of the supporting plate and an actuator supporting bracket for supporting the lifting actuator is secured at the center of the rear part of the supporting plate.

10. The sewing machine as claimed in claim 1, wherein the sewing object fixing frame is formed with one or more working regions and the sewing object is supportedly held at each working region.

11. The sewing machine as claimed in claim 1, wherein a plurality of pallets for individually holding the sewing object as a working unit are installed on the sewing object fixing frame such that the sewing object fixing frame has multiple working regions formed on the sewing object fixing frame, wherein each of the pallets is provided with a mark having information to instruct about working methods, and wherein the head portion includes a reader to read the mark, in which the reader reads the information contained in the mark to apply the information to a control part.

12. The sewing machine as claimed in claim 10, wherein a plurality of pallets for individually holding the sewing object as a working unit are installed on the sewing object fixing frame such that the sewing object fixing frame has multiple working regions formed on the sewing object fixing frame, wherein each of the pallets is provided with a mark having information to instruct about working methods, and wherein the head portion includes a reader to read the mark, in which the reader reads the information contained in the mark to apply the information to a control part.

13. The sewing machine as claimed in claim 11, wherein the mark is a bar code, and the reader is a barcode reader.

14. The sewing machine as claimed in claim 12, wherein the mark is a bar code, and the reader is a barcode reader.

15. A drive control method of a sewing machine performing a sewing operation wherein both a head portion and a bed portion move together in sync along X-axis or Y-axis direction with respect to Z-axis, the method including the steps of:

(a) positioning a sewing needle of the head portion on a sewing plate;

(b) operating an X-axis transporting motor, a Y-axis transporting motor, a head portion rotating motor and a bed portion rotating motor according to information inputted in a control part; and (c) returning to step (b) for reiterating the operations when the sewing needle is moved upward and positioned on the sewing plate atter the upper and lower shaft drive motors are operated to move the sewing needle downward to form a stitch.

16. The drive control method as claimed in claim 15, wherein the rotational speed of the upper and lower shaft drive motors is increased or decreased in proportion to the rotational speed of the X-axis transporting motor, the Y-axis transporting motor, the head portion rotating motor and the bed portion rotating motor.

17. The drive control method as claimed in claim 15, wherein the head portion rotating motor and the bed portion rotating motor are operated after the rotational speed of the upper and lower shaft drive motors is lowered.

18. The drive control method as claimed in claim 15, wherein the rotational speed of the upper and lower shaft drive motors is controlled according to rotation angles of the head portion and the bed portion.

* * * * *